Fig.1
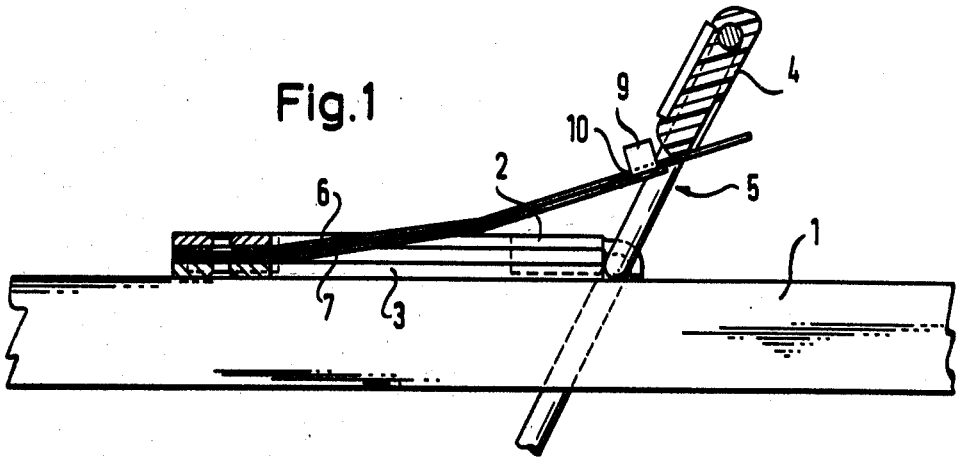
Fig.2
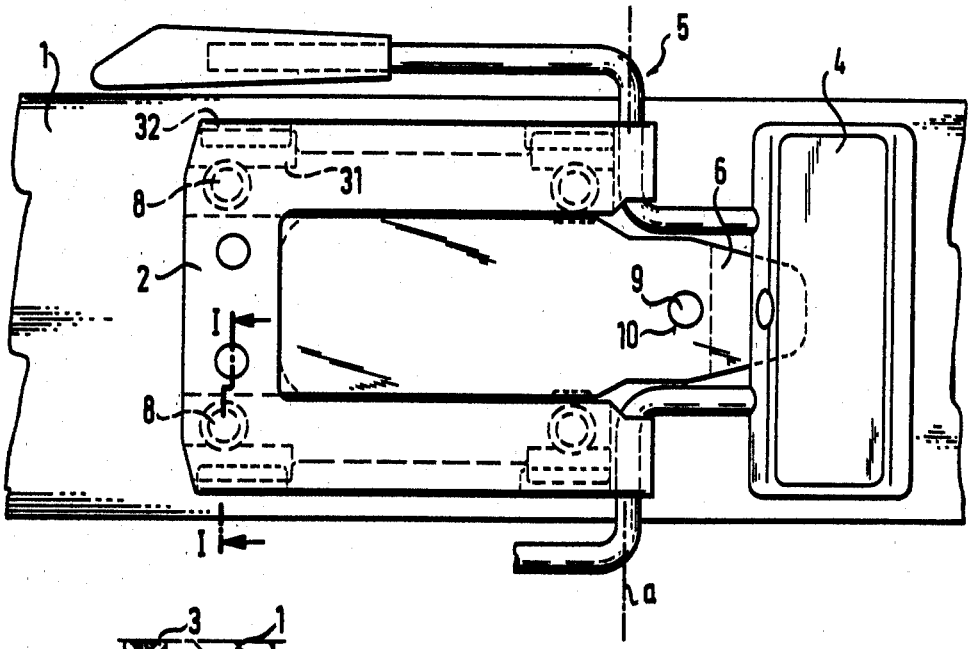
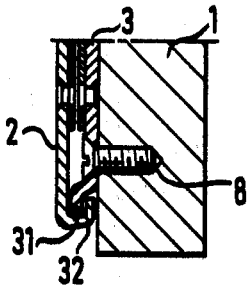
Fig.3

United States Patent [19]

Schmidt et al.

[11] 4,108,465

[45] Aug. 22, 1978

[54] SKI BRAKE

[75] Inventors: Manfred Schmidt, Sindelfingen; Heinz Luithlen, Rutesheim, both of Fed. Rep. of Germany

[73] Assignee: Vereinigte Baubeschlagfabriken, Gretsch & Co. GmbH, Leonberg, Fed. Rep. of Germany

[21] Appl. No.: 767,310

[22] Filed: Feb. 10, 1977

[30] Foreign Application Priority Data

Feb. 26, 1976 [DE] Fed. Rep. of Germany ..... 7605720

[51] Int. Cl.[2] ..... A63C 7/10

[52] U.S. Cl. ..... 280/605

[58] Field of Search ..... 280/605, 604, 633

[56] References Cited

U.S. PATENT DOCUMENTS

| | | | |
|---|---|---|---|
| 2,122,718 | 7/1938 | Hikel | 280/605 |
| 2,194,979 | 3/1940 | Jett | 280/605 |
| 3,873,108 | 3/1975 | Lacarrau | 280/604 |
| 3,992,030 | 11/1976 | Salomon | 280/605 |

FOREIGN PATENT DOCUMENTS

| | | | |
|---|---|---|---|
| 50,851 | 4/1911 | Austria | 280/604 |
| 2,606,988 | 9/1976 | Fed. Rep. of Germany | 280/605 |

*Primary Examiner*—David M. Mitchell

[57] ABSTRACT

Ski brake comprising a brake member, a bearing member having bearing lugs for pivotably carrying the brake member, a main leaf spring on the bearing member, an attachment member fixed on the ski having an additional leaf spring thereon, coupling portions on the bearing and attachment members whereby the bearing member can be detachably connected to said attachment member and guided for movement longitudinally of the ski, the additional leaf spring supporting the main leaf spring and the springs being adapted to pivot the brake member about a transverse axis of the ski into braking position. The springs also have detachable interfitting portions to secure the bearing member against movement longitudinally of the ski.

4 Claims, 3 Drawing Figures

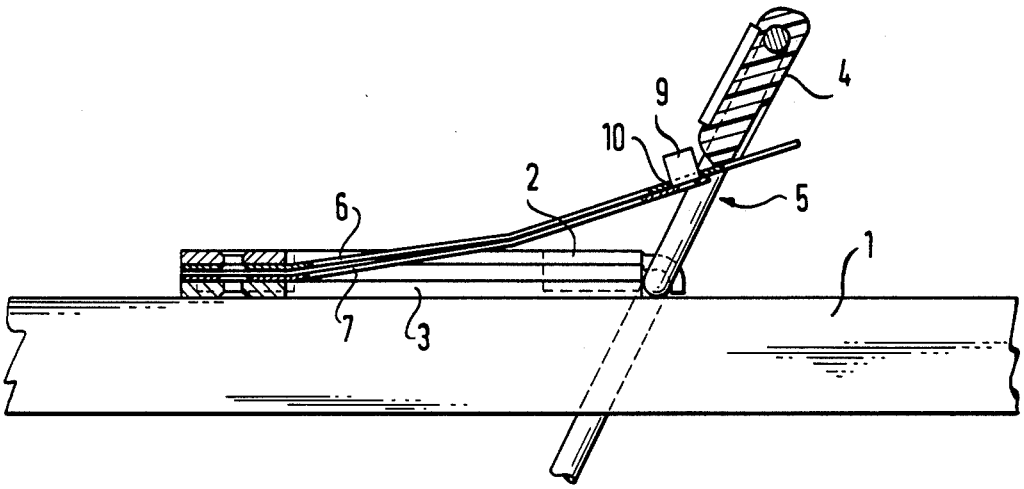

SKI BRAKE

BACKGROUND OF THE INVENTION

The invention relates to a ski brake having a brake member pivotable about a transverse axis of the ski and movable into the braking position by a leaf spring.

The disadvantage occurs when such ski brakes have no locking means so that the brake members project above the lateral edges of the skis even when not in use, e.g. during transportation. In particular, the laterally projecting parts of the ski brake impair the grinding of the steel edges. The raised ski members can also be a hindrance in figure skiing. In addition, when skiing in deep snow a ski brake is generally useless.

BRIEF SUMMARY OF THE INVENTION

The problem of the invention is therefore to obviate the disadvantages of the hitherto known ski brakes, particularly with brake members arranged in the manner indicated hereinbefore, and making it possible to grind the steel edges of the ski in an unimpeded manner.

According to the invention, this problem is solved in that a bearing member which carries the brake member and a main leaf spring has coupling means for the easy detachable connection thereof with an attachment member carrying an additional leaf spring and fixed to a ski which prevents any removal from the attachment member and provides a guide in the direction of movement. The main leaf spring and the additional leaf spring have detachable fixing means for securing the bearing member against movement thereof in the direction of movement.

As a result of the easy detachability of the bearing member, following the removal thereof it is possible to carefully re-grind the steel edges of the ski unimpeded by laterally projecting brake members. This simultaneously eliminates any risk of damaging the ski brake. It can also be advantageous, for example when transporting the skis or when skiing in deep snow to be able to rapidly remove the brakes from the skis and then equally rapidly re-fit the same.

According to a preferred embodiment of the invention, the fixing means are constructed as a shoulder fixed to the additional leaf spring and which engages in a recess of the main leaf spring. For removing the ski brake the fixing means are initially disengaged, after which the bearing member can without difficulty be disengaged from the attachment member fixed to the ski by sliding the bearing member off.

According to a simple embodiment, the fixing means are constructed in such a way that the shoulder simultaneously forms a stop member, by means of which the brake member can be locked in a specific angular braking position. As a result, any additional stop member fixed to the main leaf spring becomes superfluous.

BRIEF DESCRIPTION OF THE DRAWINGS

Other and further objects of the present invention will be apparent from the description and claims and are illustrated in the accompanying drawings which by way of illustration show preferred embodiments of the invention and the principles thereof, and what are now considered to be the best modes contemplated for applying these principles. Other embodiments of the invention embodying the same or equivalent principles may be used and structural changes may be made if desired by those skilled in the art without departing from the invention and the scope of the appended claims. In the drawings show:

FIG. 1, a side view of the ski brake in the braking position;

FIG. 2, a plan view of the ski brake in the non-braking position;

FIG. 3, a section along the section line I in FIG. 2.

DETAILED DESCRIPTION OF THE PREFERRED EMBODIMENTS

The drawings show the ski 1, bearing member 2 and attachment member 3. The two brake arms, connected together for example by a web 4, which simultaneously serves as a boot support of brake member 5, are pivotable in an appropriate manner, e.g. by bearing lugs formed on bearing member 2 about a transverse axis a of the ski on bearing member 2. In plan view, both bearing member 2 and attachment member 3 are U-shaped. Leaf springs 6 and 7, extending in the direction of the U-arms are in each case provided on the transverse member connecting said two U-arms. As can in particular be gathered from FIG. 3, the longitudinal sides of attachment member 3 fixed to ski 1 by means of screws 8 have upwardly bent elbows 31, whilst the longitudinal sides of bearing member 2 have bent portions 32 bent downwards in C-shaped manner.

The ski brake is assembled by firstly screwing the unit comprising attachment member 3 and additional leaf spring 7 to the ski by means of screws 8. The unit comprising brake member 5, main leaf spring 6 and bearing member 2 is then slid onto attachment member 3 in the longitudinal direction of the ski in such a way that bent portions 32 of bearing member 2 engage below elbows 31 of attachment member 3. Thus, the brake member is secured against removal from the ski. On sliding bearing member 2 onto attachment member 3, it is also necessary to engage the fixing means for preventing the bearing member from moving in the longitudinal direction of the ski. This is effected by introducing shoulder 9 fixed to the additional leaf spring 7 into recess 10 of main leaf spring 6. As the length of shoulder 9 is made such that it still projects beyond the main leaf spring leaf 6, it simultaneously forms a stop member locking brake member 5 in a specific angular position as the braking position as can particularly be gathered from FIG. 1. As shown in FIG. 1, the free end of the main leaf spring 6 is extended beyond the additional leaf spring 7 in the longitudinal direction of the ski, and thereby serves as a handle for disengaging the shoulder 9 from recess 10.

The invention is not limited to the embodiments described hereinbefore, and various modifications can be made thereto without passing beyond the scope of the invention.

What is claimed is:

1. A ski brake for a ski comprising a brake member, a bearing member having bearing means formed thereon for pivotably carrying said brake member, spring means for pivoting said brake member about a transverse axis of the ski into a braking position, said spring means comprising a main leaf spring provided on said bearing member extending to said brake member, an attachment member fixed to the ski, said spring means further comprising an additional leaf spring provided on said attachment member, coupling means on said bearing and attachment members for easy detachable connection of said bearing member with said attachment member with said additional leaf spring supporting said main leaf spring, said coupling means further providing a guide for movement of said bearing member longitudinally of the ski, and detachable fixing means on said main and additional springs for interconnecting said springs and securing said bearing member against said movement.

2. A ski brake according to claim 1, wherein the fixing means is constructed as a shoulder fixed to the additional spring leaf and which engages in a recess of the main spring leaf.

3. A ski brake according to claim 2, wherein the shoulder projects above the main leaf spring and forms a stop member for engaging said brake member in a position of its pivotal movement whereby said brake member can be limited to a specific angular braking position.

4. A ski brake according to claim 1, wherein said main leaf spring has a free end extended beyond the additional leaf spring in the longitudinal direction of the ski, said extension serving as a handle for disengaging the fixing means.

* * * * *